US010295300B2

(12) United States Patent
Ma

(10) Patent No.: US 10,295,300 B2
(45) Date of Patent: May 21, 2019

(54) TOY GUN

(71) Applicant: Alex Brands Buzz Bee Toys (HK) Limited, Kowloon (HK)

(72) Inventor: Chor-Ming Ma, Kowloon (HK)

(73) Assignee: Alex Brands Buzz Bee Toys (HK) Limited, Kowloon (HK)

( * ) Notice: Subject to any disclaimer, the term of this patent is extended or adjusted under 35 U.S.C. 154(b) by 0 days.

(21) Appl. No.: 15/714,306

(22) Filed: Sep. 25, 2017

(65) Prior Publication Data

US 2018/0094898 A1 Apr. 5, 2018

(30) Foreign Application Priority Data

Oct. 5, 2016 (HK) ..... 16111581

(51) Int. Cl.
*F41B 9/00* (2006.01)

(52) U.S. Cl.
CPC ..... *F41B 9/0012* (2013.01); *F41B 9/0071* (2013.01)

(58) Field of Classification Search
CPC ..... F41B 9/0012; F41B 9/0071
See application file for complete search history.

(56) References Cited

U.S. PATENT DOCUMENTS 3,228,570 A * 1/1966 Steiman ..... B05B 11/007 222/321.2
4,222,501 A * 9/1980 Hammett ..... B05B 11/303 222/207
5,074,437 A * 12/1991 D'Andrade ..... B05B 9/0426 222/400.8
6,209,761 B1 * 4/2001 Bonningue ..... B05B 11/3001 222/321.7
2002/0074350 A1 * 6/2002 Jones ..... A47J 31/41 222/146.5
2006/0261087 A1 * 11/2006 Amron ..... F41B 9/0018 222/79
2011/0315710 A1 * 12/2011 Ma ..... F41B 9/0037 222/79
2013/0192576 A1 * 8/2013 Ma ..... F41B 9/0037 124/73
2018/0094898 A1 * 4/2018 Ma ..... F41B 9/0071

* cited by examiner

*Primary Examiner* — David P Angwin
*Assistant Examiner* — Bob Zadeh

(57) ABSTRACT

The invention relates to a device for controlling a liquid discharge from a toy gun, comprising: a chamber adapted to receive a pressurized liquid, the chamber comprising at least a first sub-chamber and a second sub-chamber, an outlet arranged at the chamber to enable a discharge of at least some of the pressurized liquid received in the chamber; a movable member movably arranged in the chamber; wherein the movable member is movable from a first position to a second position in response to a drop in liquid pressure in the first sub-chamber when compared to a liquid pressure in the second sub-chamber, wherein, at the first position, the movable member is arranged to close the outlet to thereby prevent liquid discharging from the chamber, and, at the second position, the movable member is arranged to open the outlet to thereby allow some of the pressurized liquid to discharge from the chamber. The invention also relates to a toy gun for discharging a liquid, comprising: a tank adapted to store a liquid; a nozzle adapted to discharge under pressure at least some of the liquid stored in the tank; and a conduit adapted to fluidly connect the above described device with the tank.

18 Claims, 7 Drawing Sheets

TOY GUN

FIELD OF THE INVENTION

The invention relates to a toy and, particularly, but not exclusively, to a toy gun adapted to discharge liquid such as water.

BACKGROUND OF THE INVENTION

A variety of water discharging toys such as, but not limited to, water firing toy guns of various types are available in the market. Particularly, toy water guns have been designed with functional features in order to enhance the experience of the user during the loading and firing of water. For example, traditional toy water guns have been modified to discharge water jet with higher speed and/or pressure. Various flow control mechanisms have been attempted and developed to further improve the operation of toy water guns.

OBJECTS OF THE INVENTION

An object of the present invention is to provide a device for controlling a liquid discharge from a toy gun.

Another object of the present invention is to provide a toy gun with improved control features for discharging liquid.

A further object of the present invention is to mitigate or obviate to some degree one or more problems associated with known liquid emitting toys, or at least to provide a useful alternative.

The above objects are met by the combination of features of the main claim; the sub-claims disclose further advantageous embodiments of the invention.

One skilled in the art will derive from the following description other objects of the invention. Therefore, the foregoing statements of object are not exhaustive and serve merely to illustrate some of the many objects of the present invention.

SUMMARY OF THE INVENTION

In a first main aspect, the invention provides a device for controlling a liquid discharge from a toy gun. The device comprises a chamber adapted to receive a pressurized liquid, the chamber comprising at least a first sub-chamber and a second sub-chamber; an outlet arranged at the chamber to enable a discharge of at least some of the pressurized liquid received in the chamber; a movable member movably arranged in the chamber; wherein the movable member is movable from a first position to a second position in response to a drop in liquid pressure in the first sub-chamber when compared to a liquid pressure in the second sub-chamber, wherein, at the first position, the movable member is arranged to close the outlet to thereby prevent liquid discharging from the chamber, and, at the second position, the movable member is arranged to open the outlet to thereby allow some of the pressurized liquid to discharge from the chamber.

In a second main aspect, the invention provides a toy gun for discharging a liquid. The toy gun comprises a tank adapted to store a liquid; a nozzle adapted to discharge under pressure at least some of the liquid stored in the tank; and a conduit adapted to fluidly connect the device of the first main aspect with the tank.

The present invention is advantageous in that it provides a stored liquid induced liquid discharging mechanism of a toy water gun. In response to a change of the internal liquid pressure of the toy gun, or more specifically, a drop in liquid pressure in the first sub-chamber of the toy gun when compared to liquid pressure of the second sub-chamber of the toy gun, the mechanism is adapted to control movement of a movable, stopper member which consequently, opens the outlet to thereby allow discharge of the pressurized liquid via a nozzle. The mechanism allows discharge of a fast, pressurized water jet from the toy gun, which significantly enhances the experience of the user. The present invention is also advantageous to allow the opening of a relatively large sized outlet against a high fluid pressure by using a relatively small trigger force. The summary of the invention does not necessarily disclose all the features essential for defining the invention; the invention may reside in a sub-combination of the disclosed features.

BRIEF DESCRIPTION OF THE DRAWINGS

The foregoing and further features of the present invention will be apparent from the following description of preferred embodiments which are provided by way of example only in connection with the accompanying figure, of which.

DESCRIPTION OF PREFERRED EMBODIMENTS

The following description is of preferred embodiments by way of example only and without limitation to the combination of features necessary for carrying the invention into effect.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Figure 1:
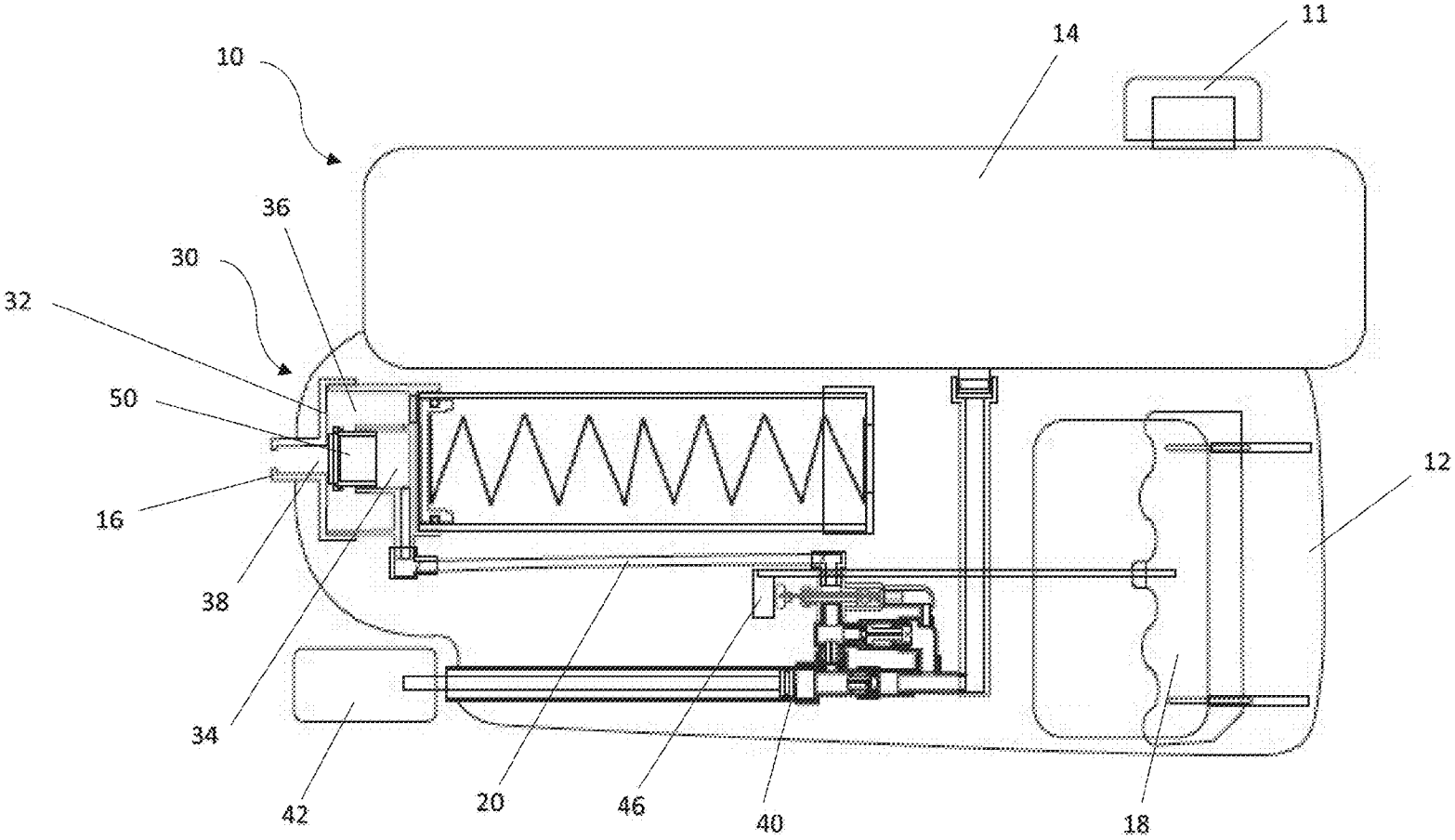
FIG. 1 is a side, internal view of a toy gun having a liquid discharge controlling device according to an embodiment of the present invention.

Referring to FIG. 1, shown is a liquid discharging toy in the form of a toy gun 10 according to an embodiment of the present invention. The toy gun 10 is generally configured with a gun body 12, a liquid tank 14 adapted to be filled via a tank opening 11 and to store a liquid such as water, a nozzle 16 for discharging at least some of the liquid under pressure, and a trigger 18 for triggering discharge of the liquid by the user. The toy gun 10 further comprises a device 30 for controlling liquid discharge from the toy gun 10, a conduit 20 for fluidly connecting the device 30 with a pump 40 for delivering the liquid from the tank 14 to the device 30.

Figure 2:
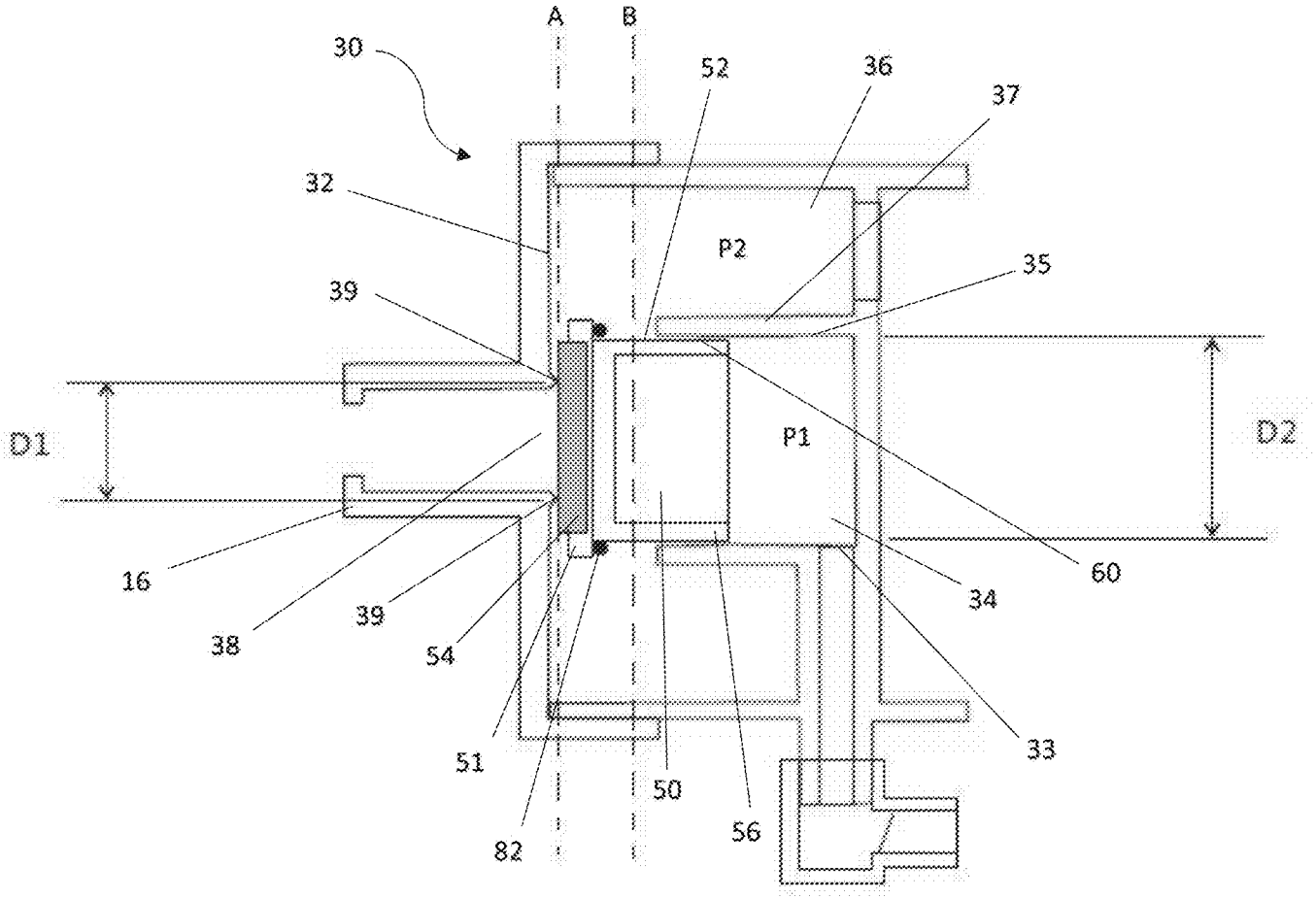
FIG. 2 is a magnified view of the liquid discharge controlling device of FIG. 1.

Features of the device 30 can be more clearly seen in the magnified view of FIG. 2. Specifically, the device 30 may comprise a chamber 32 adapted to receive some liquid from the tank 14 pressurized by the pumping action of the pump 40. The chamber 32 may comprise at least a first sub-chamber 34 and a second sub-chamber 36. A liquid inlet 33 can be provided at the first sub-chamber 34 for receiving the pressurized liquid into the chamber 32. An outlet 38 may further be provided at a forward facing direction of the chamber 32 to enable a discharge of the pressurized liquid from the chamber 32, and more specifically, from the second sub-chamber 36 of the chamber 32.

The first sub-chamber 34 can be arranged to movably engage a movable member 50, such that the movable member 50 is movable from a first position (A) to a second position (B) in response to a drop in liquid pressure ($P_1$) in the first sub-chamber 34, and particularly, when compared to the liquid pressure ($P_2$) in the second sub-chamber 36. At the first position (A), the movable member 50 is arranged to close or block the outlet 38 to thereby prevent liquid discharging from the chamber 32, whereas at the second position (B), the movable member 50 is arranged to open or unblock the outlet 38 to thereby allow some or all of the pressurized liquid in the chamber 32 to discharge via the outlet 38. The mechanism of the control device 30 to open the outlet 38 as induced by a change of liquid pressure will be explained in detail in the following description. The movable member 50 may comprise a piston or the like.

In one embodiment, the movable member 50 may comprise an outer side wall 52 slidably engageable with an inner side wall 35 of the first sub-chamber 34. Preferably, the movable member 50 may comprise a piston member 56 slidably movable along a longitudinal axis of a cylinder member 37 of the first sub-chamber 34. The outer side wall 52 of the movable member 50 and the inner side wall 35 of the first sub-chamber 34 define a narrow liquid pathway 60, which allows fluid communication between the first sub-chamber 34 and the second sub-chamber 36. Particularly, the liquid pathway 60 is configured to be sufficiently narrow such that it restricts or delays flow of the pressurized liquid between the first sub-chamber 34 and the second sub-chamber 36.

Preferably, the movable member 50 comprises a front end 51 i.e. the end adjacent the outlet 38 of the device 30, and the front end 51 can be provided with a sealing member 54 for sealingly engaging an aperture comprising the outlet 38. The sealing member 54 may comprise any known sealing means, such as a rubber seal or the like, which is capable of providing a tight, preferably leak-proof sealing of the outlet 38 once the movable member 50 is brought into engagement with the outlet 38. In one further embodiment, the outlet 38 may be configured with a ridge portion 39 which surrounds the outlet 38 to facilitate a more secure sealing between the outlet 38 and the sealing member 54.

More preferably, the outlet 38 may comprise a transverse cross-sectional dimension which is substantially smaller than a transverse cross-sectional dimension of the first sub-chamber 34. For example, in the embodiment as shown in the figures, the outlet 38 comprises a diameter (D1) which is substantially smaller than a diameter (D2) of the first sub-chamber 34.

Referring to FIGS. 3 to 6, shown are the operating mechanisms and the steps involved in one charging and firing cycle of the toy water gun 10, during which some water from the tank 14 will be charged and delivered to the device 30, and eventually, discharged as a water jet via the nozzle 16.

Figure 3:
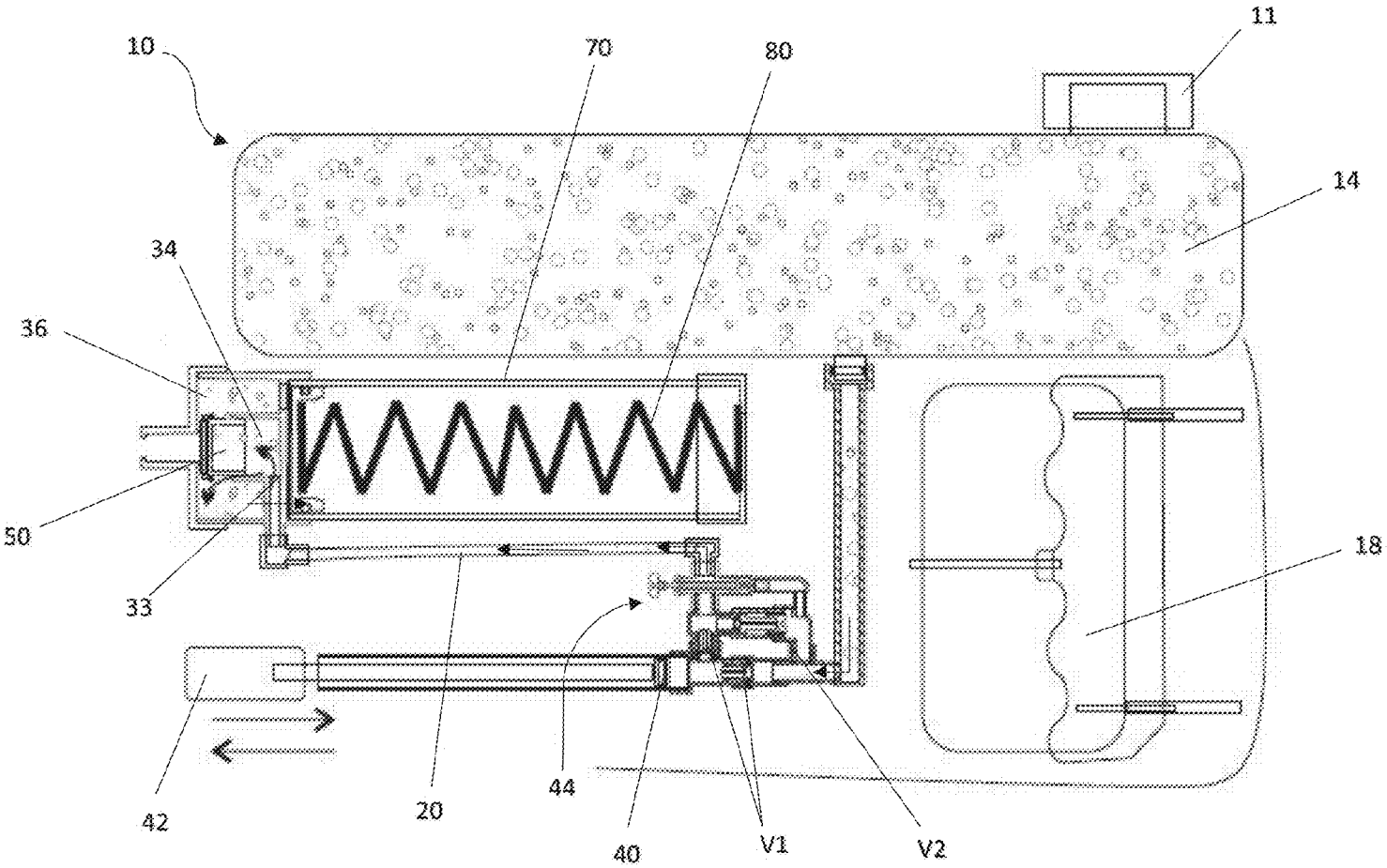
FIG. 3 is a side, internal view of the toy gun of FIG. 1 showing the pumping of liquid into the chamber of the device.

FIG. 3 shows the pumping of the stored liquid at tank 14 and the delivery of the charged water to the device 30. The pumping can be conducted by, for example, a reciprocal movement of the pump handle 42 of the pump 40 by the user. Specifically, some of the liquid from the tank 14 will be delivered under pressure along a series of conduits 20, and subsequently, enters the first sub-chamber 34 via the liquid inlet 33. The series of conduits 20 may comprise a valve system 44 for controlling the liquid flow between the tank 14 and the device 30. For example, the valve system 44 may comprise at least a first valve (V1) which allows a forward liquid flow from the tank 14 to the device 30, and at least a second valve (V2) which controls liquid pressure by redirecting the liquid to flow back to the tank 14 if its pressure has exceeded a certain, predetermined value.

Figure 4:
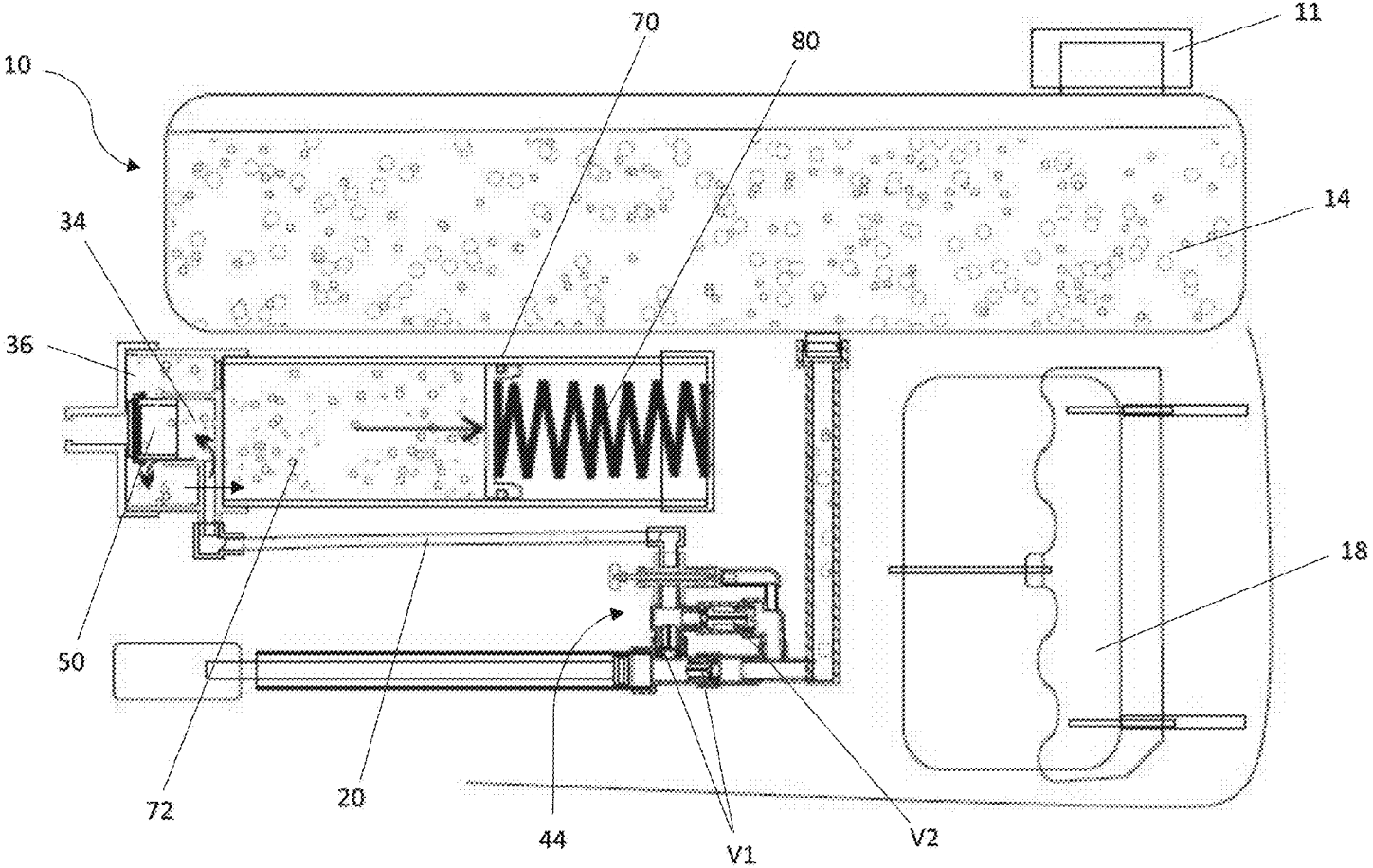
FIG. 4 is a side, internal view of the toy gun of FIG. 1 showing the charging of liquid into a pressure chamber under the action of a biasing means.

After passing through the first valve (V1) of the conduit 20, the pressurized liquid will enter the first sub-chamber 34 via the inlet 33 and then pass from the first sub-chamber 34 to the second sub-chamber 36 via the restricted flow pathway 60. The pressurized liquid entering the first sub-chamber 34 via the inlet 33 causes the movable member 50 to move to its first position sealing the outlet 38 if the movable member 50 is not already in the first position. In this embodiment, the second sub-chamber 36 is fluidly connected with a pressure chamber 70 having a cavity 72 to temporarily store the charged liquid. Particularly, the pressure chamber 70 is provided therein with a biasing means 80 such that, when the cavity 72 is being filled with the pressurized liquid from the second sub-chamber 36, as shown in FIG. 4, the biasing means 80 is capable of maintaining the pressure of the pressurized liquid as received in the cavity 72, and the second sub-chamber 36. In this specific embodiment, the biasing means 80 comprises a compression spring 80 which resiliently acts against the inflow of the pressurized liquid from the second sub-chamber 36, although a person skilled in the art would appreciate that the biasing means of the present invention should not be limited to a compression spring, but any other means which is capable of achieving the same purpose should also be encompassed by the present invention.

Figure 5:
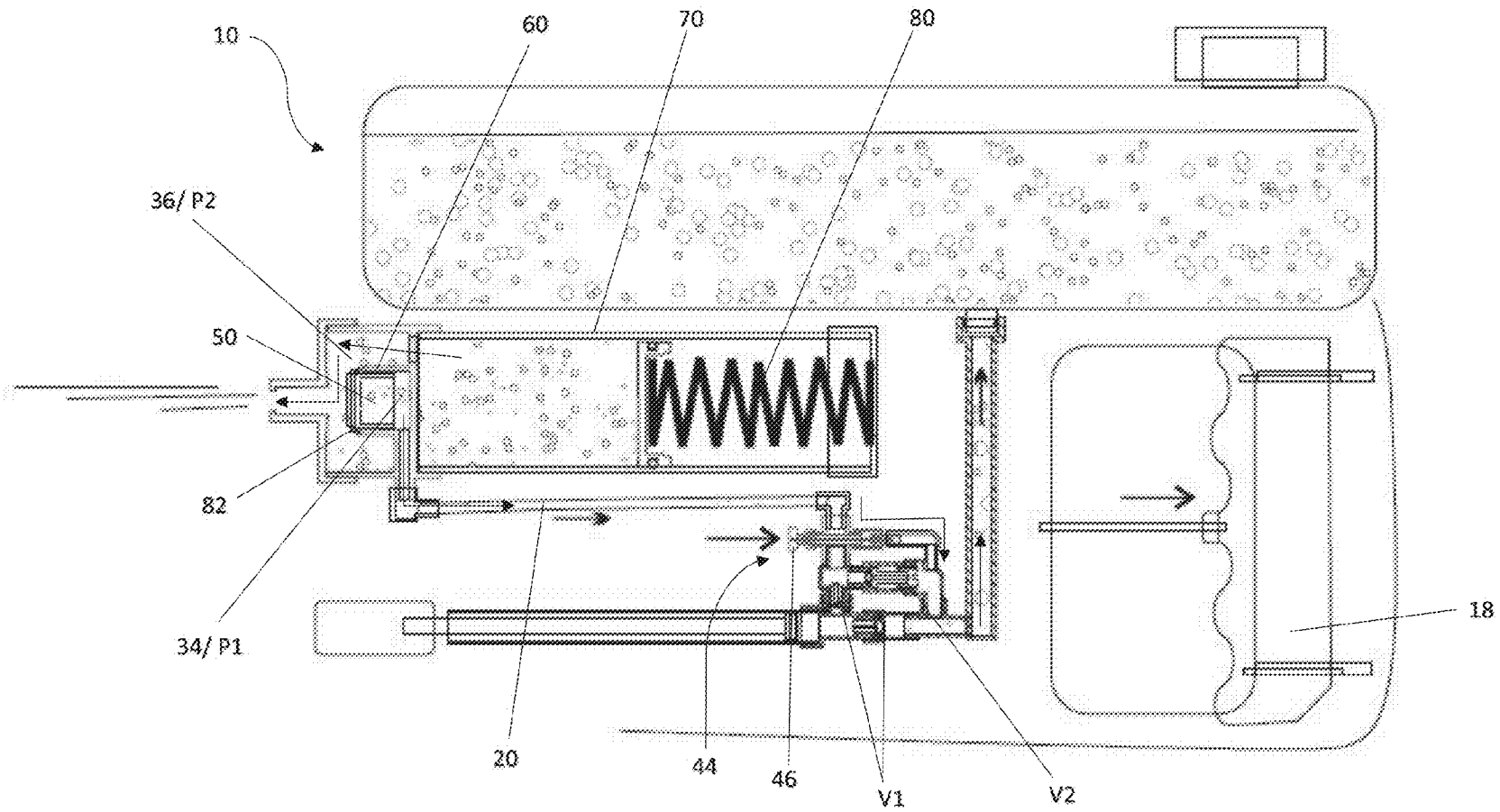
FIG. 5 is a side, internal view of the toy gun of FIG. 1 showing the actuation of a triggering means to discharge the charged liquid via a nozzle.

FIG. 5 shows the step to discharge the pressurized liquid from the toy gun 10 via a nozzle 16. When the trigger 18 is depressed or in any applicable way triggered by the user, an actuating means 46 of the valve system 44, which is mechanically linked to the trigger 18, will be simultaneously actuated such that a reverse flow path from the first sub-chamber 34 towards the tank 14 will be opened. As a consequence, the pressurized liquid at the first sub-chamber 34 will be released via the conduit 20 and some or all of such liquid possibly returned to the tank 14. The liquid pressure (P1) in the first sub-chamber 34 will drop as a result. At the same time, the pressurized liquid at the second sub-chamber 36, also being assisted by the applied pressure from the biasing means 80, will be forced to leak through the flow restricting pathway 60 to the first sub-chamber 34 under pressure to replenish the released liquid. However, it should be noted that, the flow of the replenishing liquid from the second sub-chamber 36 to the first sub-chamber 34 will be delayed by the narrow, restricted pathway 60 and thus, the pressurized liquid from the second sub-chamber 36 will not be able to flow back into the first sub-chamber 34 sufficiently quickly enough to equalize the pressure (P2) between the second sub-chamber 36 and the pressure (P1) in the first sub-chamber 34. The drop in pressure (P1) in the first sub-chamber 34 when compared to the pressure (P2) in the second sub-chamber 36, thus enables the movable member 50 to move from its first position (A) towards its second position (B) to thereby open the outlet 38 and thus the nozzle 16.

Once the outlet 38 is opened, it allows a fast discharge of some or all of the charged water stored in the pressure chamber 70 and the second sub-chamber 36 via the nozzle 16 to create a fast water jet to be emitted from the toy gun. The biasing means 80 further assists in discharging liquid under pressure from the second sub-chamber 36 through the outlet 38 and the nozzle 16 once a pressure drop is triggered in the first sub-chamber 34. The pressurized liquid will only be discharged from the second sub-chamber 36 and pressure chamber 70 via the nozzle 16. After the release of liquid from the first sub-chamber 34 and pressure chamber 70, where provided, which is followed by a drop of the liquid pressure (P1) to substantially atmospheric pressure, a small amount of liquid may leak in slowly from the second sub-chamber 36 via the flow restricting pathway 60 to refill the first sub-chamber 34 over a period of time to slow down the pressure drop rate. Nevertheless, the pressure in the first sub-chamber (P1) is still comparatively lower than the pressure in the second-sub-chamber (P2). The resultant force will therefore still push the movable member 50 towards position (B) and remain there to leave the outlet 38 open until the temporarily stored liquid in the pressure chamber 70 and the second sub-chamber 36 is substantially fully discharged.

In one preferred embodiment, the outlet 38 is configured to comprise a diameter (D1) which is smaller than a diameter of the first sub-chamber 34 (D2), which is more clearly shown in FIG. 2. This is of particular significance to facilitate movement of the movable member 50 effectively from the first position (A) to the second position (B) as induced by the liquid pressure drop in the first sub-chamber 34, as discussed above. Particularly, it is possible that if D2 is configured to be equal or less than D1, movement of the movable member 50 from position (A) to position (B) could be compromised or even prevented by the higher pressure of the second sub-chamber (P2) even when the pressure of the first sub-chamber (P1) has dropped to a lower level.

Optionally, a sealing ring 82 may be arranged at the junction between the front end 51 of the movable member 50 and the corresponding end wall of the front sub-chamber 34 or the cylinder member 37, such that liquid leakage into the first sub-chamber 34 through the flow restricting pathway 60 is prevented or at least minimized when the movable member 50 is at the second position (B).

Figure 6:
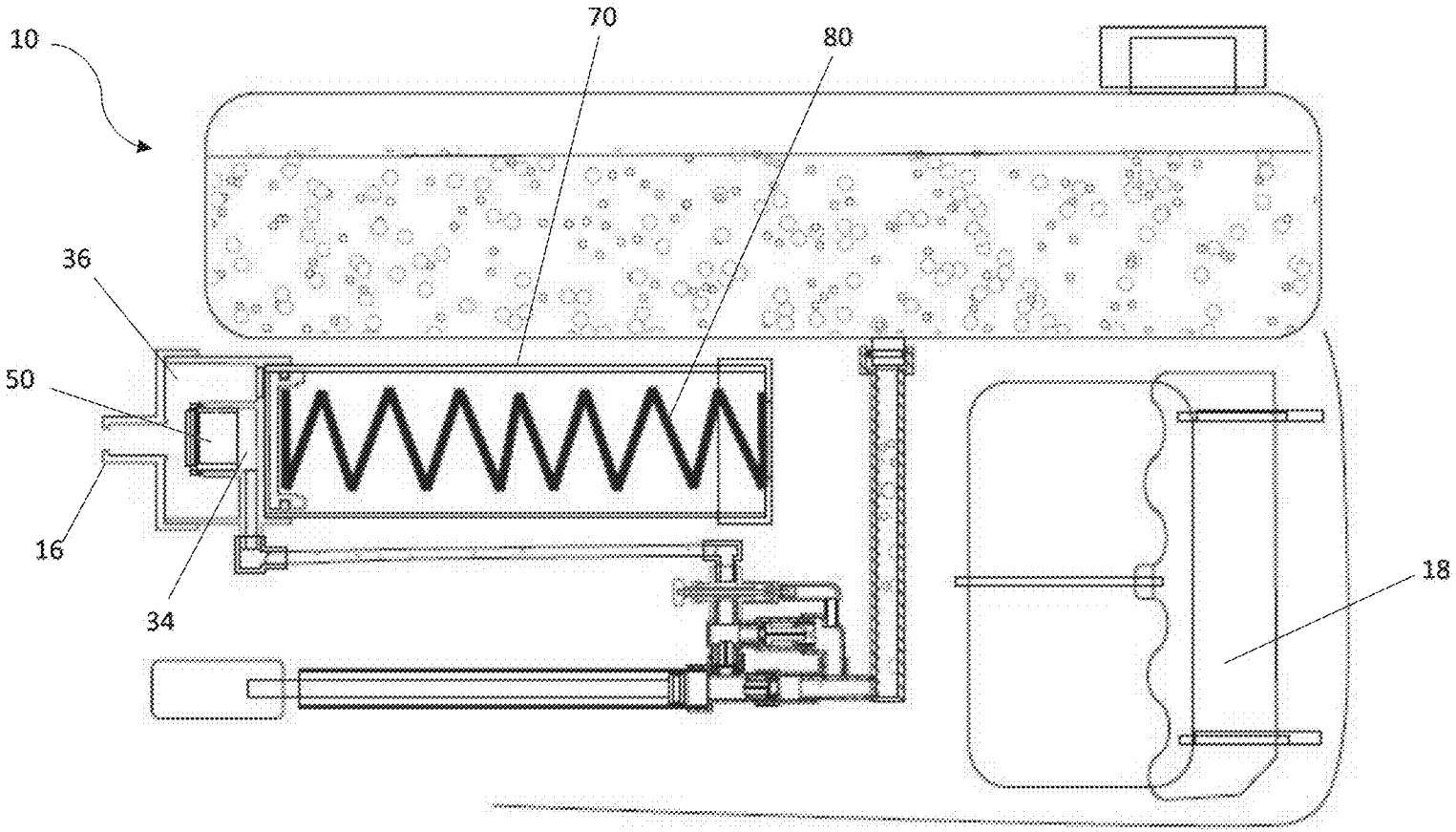
FIG. 6 is a side, internal view of the toy gun of FIG. 1 after the discharging of the charged liquid.

For every triggering event at the trigger 18 by the user, most if not all of the temporarily stored liquid in the pressure chamber 70 and the second sub-chamber 36 will be emptied and released as a single shot comprising a water jet from the nozzle 16—see FIGS. 5 and 6. The cycle as shown in FIG. 3 to FIG. 6 will then be repeated if the user chooses to operate the pump and to make a further shot. When the user recharges the gun 10 by pumping in liquid from the tank 14 into the device 30, pressurized liquid will be delivered to fill up the first sub-chamber 34 again and to close the outlet 38 by pushing the movable member 50 from the second position (B) to the first position (A).

Figure 7:
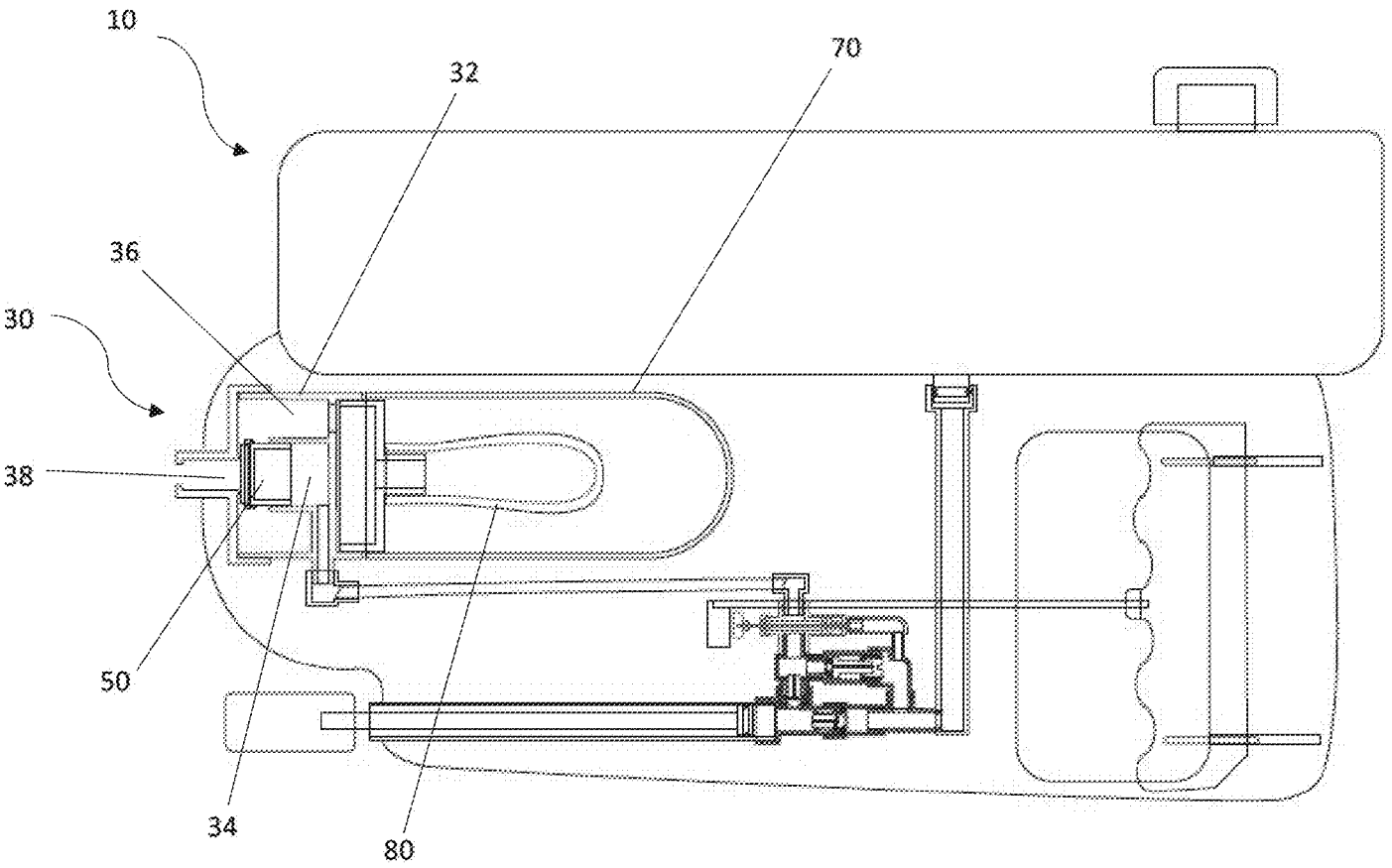
FIG. 7 is a side, internal view showing a toy gun having another embodiment of the liquid discharge controlling device according to the present invention.

FIG. 7 shows a further embodiment of the toy gun 10 according to the present invention. In this embodiment, the biasing means 80 comprises an elastic membrane such as, but not limited to, a rubber material container 80 elastically expandable when being filled with the pressurized liquid from the second sub-chamber 36. Particularly, the second sub-chamber 36 is configured to be fluidly connected with the container 80, and thus pressurized liquid from the second sub-chamber 36 will be allowed to flow into the elastic container 80 to thereby expand the container 80. At the same time, the elasticity of the container 80 will assert an opposing biasing force to resist stretching, which provides the required biasing force for propelling the contained liquid and the liquid in the second sub-chamber 36 from the toy gun via the nozzle 16.

The present invention is advantageous in that it provides a stored liquid induced liquid discharging mechanism of a toy water gun. In response to a change of the internal liquid pressure of the toy gun, or more specifically, a drop in liquid pressure in the first sub-chamber of the toy gun when compared to liquid pressure of the second sub-chamber of the toy gun, the mechanism is adapted to control movement of a movable, stopper member which consequently, opens the outlet to thereby allow discharge of the pressurized liquid via a nozzle. The mechanism allows discharge of a fast, pressurized water jet from the toy gun, which significantly enhances the experience of the user. The present invention is also advantageous to allow the opening of a relatively large sized opening against a high fluid pressure by using a relatively small trigger force.

The present description illustrates the principles of the present invention. It will thus be appreciated that those skilled in the art will be able to devise various arrangements that, although not explicitly described or shown herein, embody the principles of the invention and are included within its spirit and scope.

Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

While the invention has been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

In the claims hereof, any element expressed as a means for performing a specified function is intended to encompass any way of performing that function. The invention as defined by such claims resides in the fact that the functionalities provided by the various recited means are combined and brought together in the manner which the claims call for.

It is thus regarded that any means that can provide those functionalities are equivalent to those shown herein.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art is referred to herein, such prior art does not constitute an admission that the prior art forms a part of the common general knowledge in the art.

The invention claimed is:

1. A device for controlling a liquid discharge from a toy gun, comprising:

a chamber adapted to receive a pressurized liquid, the chamber comprising at least a first sub-chamber and a second sub-chamber;

an outlet arranged at the chamber to enable a discharge of at least some of the pressurized liquid received in the chamber;

a movable member movably arranged in the chamber to define a flow restricting pathway between the first and the second sub-chambers, the movable member is movable from a first position to a second position in response to a drop in liquid pressure in the first sub-chamber when compared to a liquid pressure in the second sub-chamber;

wherein at the first position, the movable member is arranged to close the outlet to thereby prevent liquid discharging from the chamber, and that the flow restricting pathway is arranged to allow leakage of some of the pressured liquid between the first sub-chamber and the second sub-chamber; and at the second position, the movable member is arranged to open the outlet to thereby allow the some of the pressurized liquid to discharge from the chamber, and that the flow restricting pathway is arranged to prevent or minimize liquid movement between the first and the second sub-chambers.

2. The device according to claim 1, wherein the movable member comprises an outer side wall slidably engageable with an inner side wall of the first sub-chamber.

3. The device according to claim 1, wherein the flow restricting pathway comprises a flow path defined by the outer side wall of the movable member and the inner side wall of the first sub-chamber.

4. The device according to claim 1, wherein the movable member comprises a piston member slidably movable along a longitudinal axis of a cylinder member of the first sub-chamber.

5. The device according to claim 1, wherein the movable member comprises a front end arranged to adjacent the outlet of the device, the front end being provided with a sealing member for sealingly engaging the outlet.

6. The device according to claim 1, wherein the first sub-chamber comprises an inlet for receiving the pressurized liquid into the chamber.

7. The device according to claim 1, wherein the outlet comprises a transverse cross-sectional dimension substantially smaller than a transverse cross-sectional dimension of the first sub-chamber.

8. The device according to claim 7, wherein the outlet comprises a diameter substantially smaller than a diameter of the first sub-chamber.

9. The device according to claim 1, wherein when the movable member is at the second position, the liquid discharges only from the second sub-chamber.

10. The device according to claim 1, wherein pressure of the pressurized liquid received in the chamber is maintained by a spring means.

11. A toy gun for discharging a liquid, comprising:

a tank adapted to store the liquid;

a nozzle adapted to discharge under pressure at least some of the liquid stored in the tank; and a conduit adapted to fluidly connect the device according to claim 1 with the tank.

12. The toy gun according to claim 11, further comprising a pump for delivering under pressure the liquid from the tank to the chamber of the device.

13. The toy gun according to claim 12, further comprising a valve system at the conduit adapted to control flow of the liquid between the tank and the device.

14. The toy gun according to claim 13, wherein the valve system comprises at least a first valve and a second valve, the first valve allows the liquid flow from the tank to the device, and the second valve allows the liquid flow from the device to the tank.

15. The toy gun according to claim 14, wherein the valve system further comprises an actuatator actuatable to switch between the first valve and the second valve.

16. The toy gun according to claim 11, further comprising a spring means adapted to maintain pressure of the pressurized liquid received at the chamber of the device.

17. The toy gun according to claim 16, wherein the biasing means comprises a compression spring.

18. The toy gun according to claim 16, wherein the biasing means comprises an elastic membrane elastically expandable when being filled with the pressurized liquid from the chamber.

* * * * *